United States Patent [19]

Smith et al.

[11] 3,998,351

[45] Dec. 21, 1976

[54] TEAPOT WITH SELF-CONTAINED VESSEL FOR MILK, HONEY, OR OTHER LIQUIDS

[76] Inventors: Robert J. Smith; Penelope Smith, both of 30-26 23rd St., Astoria, N.Y. 11102

[22] Filed: Dec. 9, 1974

[21] Appl. No.: 530,803

[52] U.S. Cl. ..... 220/23.83; 206/501; 215/6; 215/10; 222/143

[51] Int. Cl.[2] ..... B47G 19/00; B65D 21/02

[58] Field of Search ..... 220/23.83, 23.86; 206/501, 502; 215/6, 10; 222/143

[56] References Cited

UNITED STATES PATENTS

| | | | |
|---|---|---|---|
| 577,410 | 2/1897 | Banker | 215/100 R |
| 986,865 | 3/1911 | Russell | 222/143 |
| 2,074,230 | 3/1937 | McHahon | 222/143 |
| 2,469,032 | 5/1949 | Chaudron | 220/23.83 |
| 2,845,059 | 7/1958 | Kelleher | 220/366 |

FOREIGN PATENTS OR APPLICATIONS

| | | | |
|---|---|---|---|
| 456,193 | 11/1936 | United Kingdom | 222/143 |
| 538,737 | 8/1941 | United Kingdom | 222/143 |

*Primary Examiner*—William Price
*Attorney, Agent, or Firm*—Richard L. Miller

[57] ABSTRACT

An improved teapot set that includes a separate vessel placeable upon its top and which extends downward into the interior of the teapot so that steaming tea water in the teapot heats up milk or honey that is contained inside the vessel, the set also including a lid or cover that is placeable on top of the vessel or else directly on top of the teapot, in case the vessel is not used.

1 Claim, 5 Drawing Figures

TEAPOT WITH SELF-CONTAINED VESSEL FOR MILK, HONEY, OR OTHER LIQUIDS

This invention relates generally to teapots such as are used for serving hot tea.

It is well known to many of those persons who enjoy milk being added into their tea, that if the milk is cold it alters unfavorably the flavor of the tea. Accordingly, many such tea drinkers heat up milk in a separate vessel on the stove in order that they many enjoy their cup of tea at an ideal flavor. The heating of the milk constitutes however a separate additional chore which, of course, is objectionable and therefore, in want of an improvement.

It is therefore, a principle object of the present invention to provide a teapot set that includes a separate vessel placeable on top of a teapot and which extends downward into the teapot interior so that milk placed into the vessel is automatically heated by the steaming tea water contained in the teapot.

Another object is to provide a teapot set in which the vessel can be used for heating honey placed therein so that the honey is made less viscous and is thus easier to pour into the tea for use as a sweetener or to spread on a slice of bread, roll or toast.

Other objects are to provide a teapot with self-contained vessel for milk, honey and other liquids which is simple in design, inexpensive to manufacture, rugged in construction, easy to use and efficient in operation.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

Figure 1:
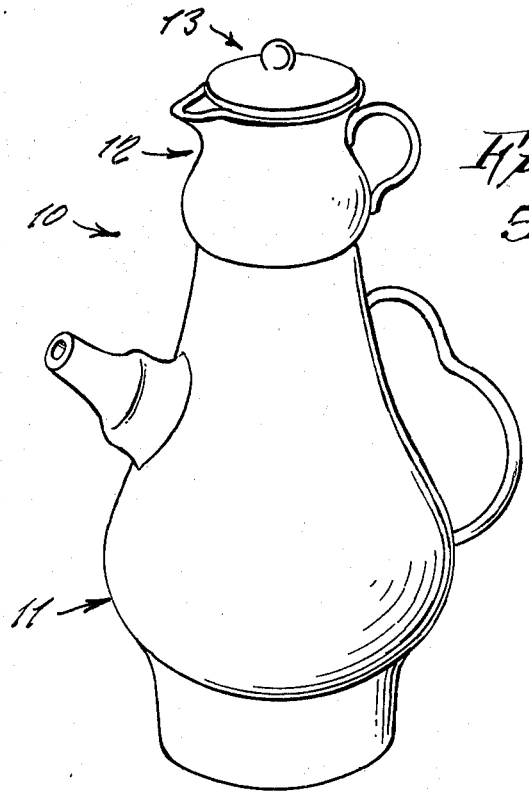
FIG. 1 is a perspective view of the invention shown assembled.

Referring now to the drawing in detail, and more particularly to FIGS. 1 through 4 thereof at this time, the reference numeral 10 represents a teapot set according to the present invention wherein the same consists of a teapot 11, a separate vessel 12 and a lid or cover 13, all of which are made of a china or other suitable material.

The teapot 11 consists of a pot 14 having a large opening 15 on top so to allow access to the pot interior for being cleaned and for allowing tea water to be poured therewithin. The pot includes a pouring spout 16 on its side from which steaming hot tea can be poured out. A handle 17 on an opposite side of the pot allows convenient handling of the hot pot.

The vessel 12 is made in the shape and size of a small pot 18 having a pouring spout 19 and which may or may not include a handle 20. The lower porton 21 of the vessel is diametrically constricted in size in order to be insertable downward into the teapot opening 15, and becoming seated therein by means of a shoulder 22, formed between the constricted lower portions and diametrically enlarged portion 23, resting upon an upper edge 24 of the teapot. Thus the vessel portion 21 is located within the diametrically larger interior 25 of the teapot so that it can be surrounded by rising steam from the hot tea water so that any substance such as milk or honey placed in the vessel can become heated to a pleasant temperature for use or may actually sit in the hot tea water to achieve the same purpose.

Figure 2:
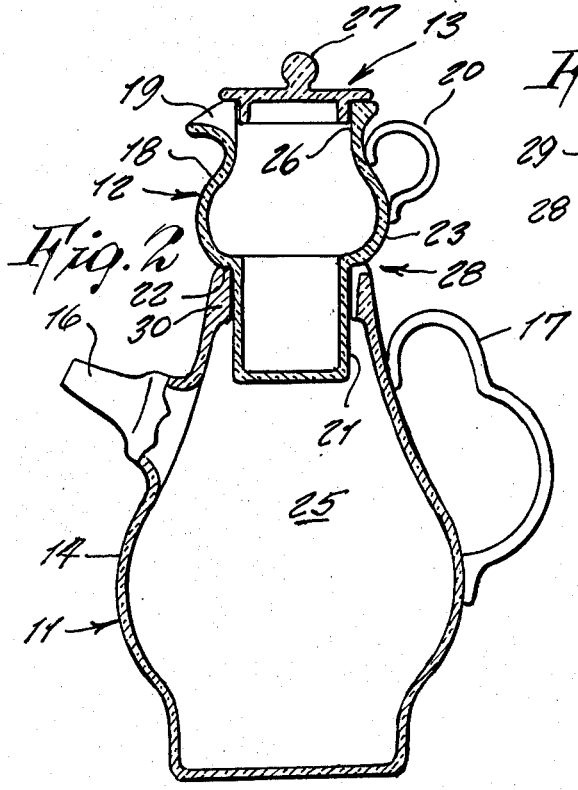
FIG. 2 is a side cross sectional view thereof.
Figure 3:
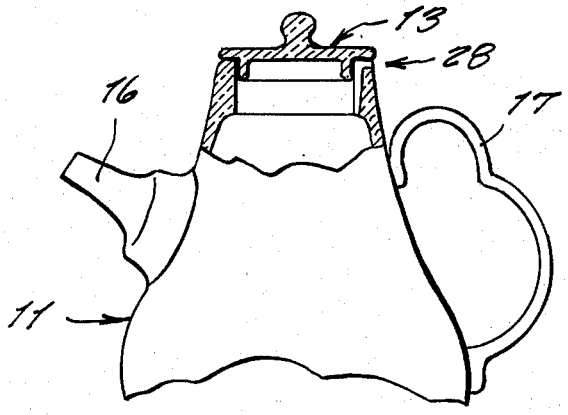
FIG. 3 is a side view, partly in cross section showing the milk container lid placed directly on the teapot.

The cover 13 is adapted to be placed either on top of the vessel or the teapot because the vessel opening 26 is a same size as the teapot opening 15, as shown in FIGS. 2 and 3, so that the set can selectively be used either with or without the vessel. The cover includes a knob 27 for conveniently lifting the cover.

Figure 4:
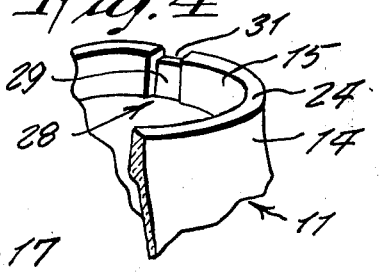
FIG. 4 is an enlarged detail showing the air vent on the upper edge of the teapot.

As shown in FIGS. 2, 3 and 4, a small steam vent 28 is provided on the teapot and consists of a vertical groove 29 on the surface of opening 15, the groove extending the full height of the narrowed neck portion 30 of the teapot so to allow communication between the interior 25 and the outside exterior. A shallow groove 31 on the upper edge 24 connects with vertical groove 29 so that they form together an L-shaped passage that does not become closed when the vessel is seated on the teapot.

Figure 5:
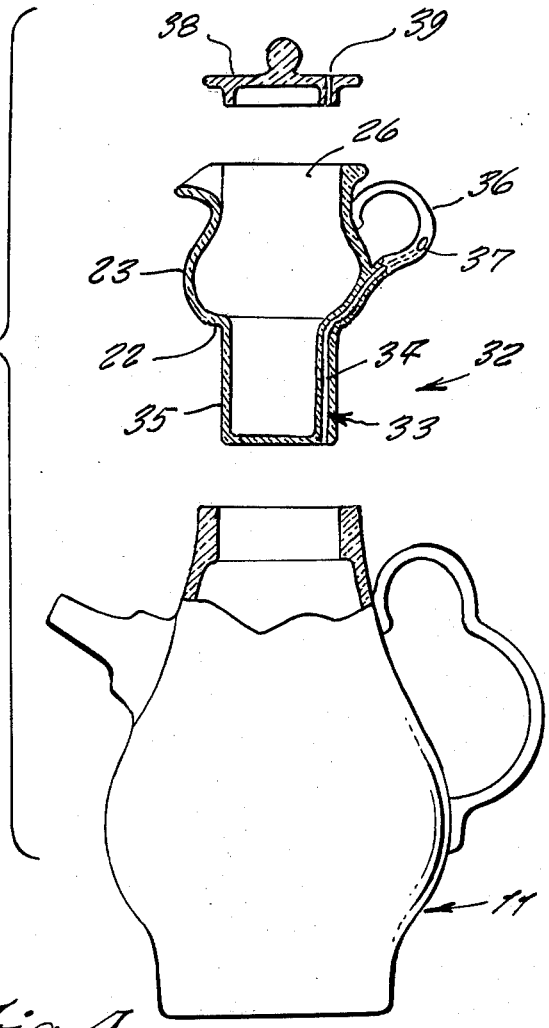
FIG. 5 is an exploded cross section of a modified design of the invention.

In FIG. 5, a modified design 32 of the invention includes all of the above-described structure except the vent 28, which is here substituted by a vent 33 in the vessel instead of the teapot.

The vent 33 comprises a narrow, transversely flat passage 34 in a side wall 35 of the vessel and which extends up into the vessel handle 36 where it ends in a side opening 37, so that the handle 36 can be likewise warmed. Thus, steam from the teapot is vented when the vessel is placed thereupon.

As shown, the cover 38 can likewise include a vent opening 39 so to vent the teapot in case it is placed directly thereupon, without use of the vessel.

Thus a modified design is presented.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. In a teapot set, the combination of a teapot, a separate vessel and a cover placeable on each other, said vessel extending approximately one half its height downward into said teapot; said teapot comprising a pot with a top opening through a neck communicating with an interior of said pot, and a spout and handle on opposite sides of said pot; said vessel comprising a pot shaped portion as its upper half with an opening on top, a spout and an ear-shaped handle on opposite sides, and a lower portion comprising a constricted stem extending downward from said pot shaped portion for insertion downward through said teapot opening and into said interior, a shoulder at an upper end of said constricted portion resting upon an upper edge of said teapot neck, the bottom of said stem forming the base of said vessel; said top openings of said teapot and vessel being a same size, and each selectively fitting said cover; said teapot interior being vented by a passage within an interior of a sidewall of said vessel, said passage at its lower end having an inlet port through a bottom wall of said vessel for communication with said teapot interior, said passage extending into an interior of said vessel handle and having an outlet port in a vicinity of a longitudinally center portion of said handle, said passage being narrow and flat, said passage outlet port being on one side of said handle so as to form a side opening, and wherein said cover includes a vent means for venting said vessel when positioned thereon and for venting said teapot when positioned thereon.

* * * * *